US005674149A

United States Patent [19]

Schaper et al.

[11] Patent Number: 5,674,149

[45] Date of Patent: Oct. 7, 1997

[54] INFLATABLE GAME BALL

[76] Inventors: Hubertus Cornelis Joseph Schaper, De Vang 3, NL-1622 GA Hoorn; Franciscus Ferdinandus Jozef Schaper, Vijverbos 100, NL-2134 GV Hoofddorp, both of Netherlands

[21] Appl. No.: 553,744

[22] Filed: Oct. 23, 1995

Related U.S. Application Data

[63] Continuation of Ser. No. 373,260, Feb. 28, 1995, abandoned.

[30] Foreign Application Priority Data

Jul. 30, 1992 [NL] Netherlands ..... 9201381

[51] Int. Cl.[6] ..... A63B 41/08

[52] U.S. Cl. ..... 473/593; 473/604; 473/607; 473/609; 473/597; 473/599

[58] Field of Search ..... 473/593, 597, 473/598, 599, 603, 604, 605, 607, 608, 609

[56] References Cited

U.S. PATENT DOCUMENTS

| | | | |
|---|---|---|---|
| D. 263,491 | 3/1982 | Serridge . | |
| D. 268,853 | 5/1983 | Brine, Jr. . | |
| D. 270,851 | 10/1983 | Feger . | |
| D. 290,632 | 6/1987 | Dehnert et al. . | |
| D. 299,845 | 2/1989 | Gray . | |
| D. 299,940 | 2/1989 | Fitzgerald et al. . | |
| D. 306,469 | 3/1990 | Norman et al. . | |
| D. 306,470 | 3/1990 | Norman et al. . | |
| D. 330,239 | 10/1992 | Obermann . | |
| 3,199,871 | 8/1965 | Dorn . | |
| 4,318,544 | 3/1982 | Brine, Jr. . | |
| 4,542,902 | 9/1985 | Massino | 273/65 A |
| 4,620,842 | 11/1986 | Wang . | |
| 4,830,373 | 5/1989 | Dehnert | 273/58 BA |
| 5,236,196 | 8/1993 | Blankenburg et al. . | |
| 5,286,020 | 2/1994 | Caruso | 273/58 BA |

FOREIGN PATENT DOCUMENTS

| | | |
|---|---|---|
| 446898 | 8/1942 | Belgium . |
| 0 383 714 | 8/1990 | European Pat. Off. . |
| 1.088.671 | 3/1955 | France . |
| 1.103.710 | 11/1955 | France . |
| 2 596 182 | 9/1987 | France . |
| 805 816 | 5/1951 | Germany . |
| 25 41 889 | 3/1977 | Germany . |
| 87 11 005.9 | 11/1987 | Germany . |
| 89 08 027.0 | 11/1989 | Germany . |
| 016 688 | 5/1990 | Germany . |
| 8001207 | 10/1981 | Netherlands . |
| 1 378 869 | 3/1988 | U.S.S.R. . |
| 2 008 836 | 6/1979 | United Kingdom . |
| 2 201 281 | 8/1988 | United Kingdom . |
| DM/016 688 | 5/1990 | WIPO . |
| WO 93/03469 | 2/1993 | WIPO . |

OTHER PUBLICATIONS

J. Seidel, "Meetkunde van de ruimte", De Voetbal.

Van Werven, "Deer Balanced New Cut", SS 2203, Sep. 1992.

A. van der Vegt, "Regelmaat in de ruimte", 3 pages.

(List continued on next page.)

*Primary Examiner*—George J. Marlo

*Attorney, Agent, or Firm*—Young & Thompson

[57] ABSTRACT

An inflatable ball for ball games comprises an outer ball having interconnected parts consisting of twelve equilateral pentagons (1) and twenty equiangular hexagons (2). Each pentagon (1) is enclosed by five hexagons (2) and at the location of the connection between a pentagon (1) and a hexagon (2) the sides connected to one another are of equal length. In order to minimize, and preferably reduce to zero, the difference in stress in the material of the hexagons (2) and pentagons (1) when the ball is in the inflated state, each of the hexagons (2) has three sides (a) of relatively great length connected to a pentagon (1), and three sides (b) of relatively small length connected to a hexagon (2), the length of the short sides (b) being at least 0.69 times the length of the long sides (a). Preferably, b=0.839 a.

2 Claims, 1 Drawing Sheet

OTHER PUBLICATIONS

Deer Balanced No. 1, Silver Star Enterprises (PVT) Ltd., 1991, Silver Star Road, Sialkot 51310 Pakistan, 3 pages.

Back cover of 1991 catalog, Silver Star Enterprises (PVT) Ltd..

Schaper et al., "Comments by Geo Design inventors on Deer Balanced New Cut", Sep., 1992, pp. 1–3.

INFLATABLE GAME BALL

This application is a continuation of application Ser. No. 08/373.260, filed Feb. 28, 1995, now abandoned.

The invention relates to an inflatable ball for ball games, in particular football, comprising an outer ball having interconnected parts consisting of twelve equilateral pentagons and twenty equiangular hexagons, each pentagon being enclosed by five hexagons and, at the location of the connection between a pentagon an a hexagon, the sides connected to one another being of equal length.

In a design of this ball which is generally known, the hexagons are equilateral. It has been found that, in the inflated state, the stress in the material of the hexagons is markedly greater than the stress in the material of the pentagons. If the ball is kicked, the path through which the ball travels, the speed of the ball and the so-called spin will depend on the spot where the ball is struck. The behaviour of that ball when it bounces is also dependent on whether the ball strikes the ground with a hexagon or a pentagon. It will be obvious that such uncertainty is undesirable, in particular with top sportsmen. The difference in stress and the degree of stretch in the material of the hexagons and pentagons can be explained by imagining what happens if a perfectly spherical inner ball is inflated inside the outer ball consisting of pentagons and hexagons. It appears that the hexagons come into contact with the inner ball sooner than the pentagons, while when the pentagons are touching the inner ball in only one spot, the hexagons are already touching the inner ball with a relatively large surface.

Another disadvantage of the difference in stress and the degree of stretch in the material of the hexagons and pentagons is that the seams between the hexagons themselves are subject to greater forces and consequently split and wear more quickly than the seams between the hexagons and the pentagons. In addition, the hexagons on average wear more quickly than the pentagons, and the same goes for the protective coating layer. Apart from the behaviour of the ball regarding flight, bounce and wear, the spherical shape is also improved. The conventional football is not completely spherical and during the production process a certain number of balls are rejected as they do not meet set tolerance requirements in respect of roundness, weight and position of the centre of gravity.

The object of the invention is to avoid the abovementioned disadvantages and to provide an inflatable ball as indicated in the preamble, whose haxagons and pentagons—in the inflatable state of the ball—are subjected to essentially equal material stresses and degrees of stretch and whose spherical shape is improved.

To this end, according to the invention, the ball is characterised in that each of the hexagons has three sides of relatively great length connected to a pentagon and three sides of relatively small length connected to a hexagon, and the length of the short sides is at least 0.69 times the length of the long sides, preferably 0.839 times the length of the long sides.

Obviously, this ratio is to be preferred, because the material stresses and the degree of stretch of the hexagons and pentagons in the inflated state of the ball are virtually equal.

Incidentally, in order to achieve the effect according to the invention, the ball according to the invention does not necessarily have to comprise an inner ball, and if the ball according to the invention does have an inner ball, said inner ball will usually be glued to the outer ball consisting of pentagons and hexagons.

The invention will be explained in more detail below by reference to the figures.

Figure 1:
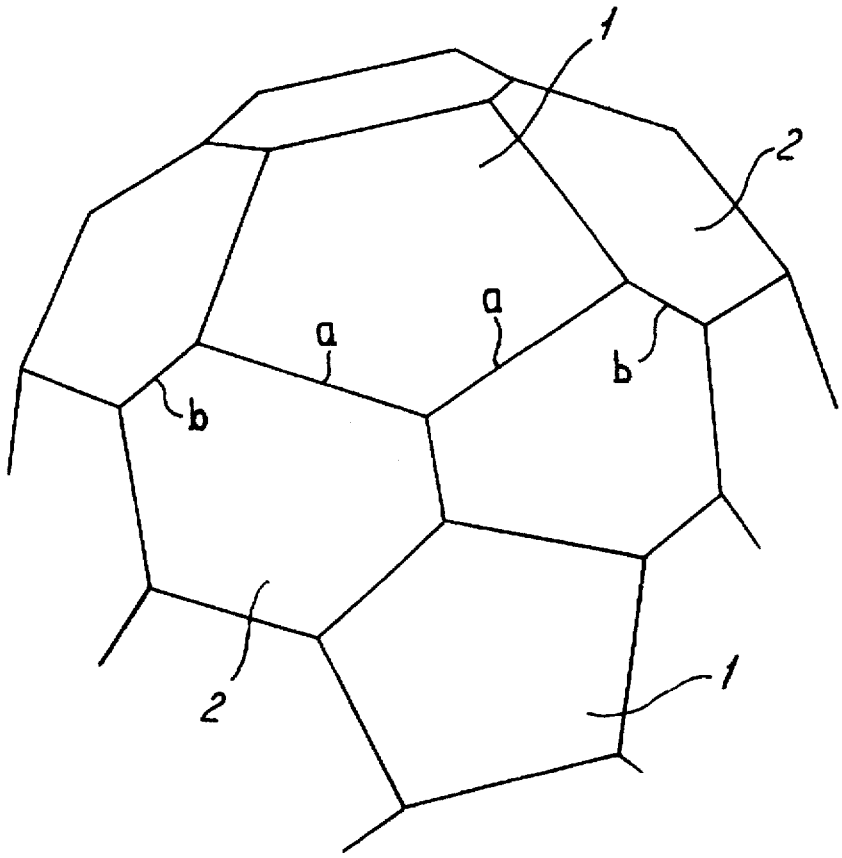
FIG. 1 shows a perspective view—not to scale—of a part of the ball according to the inventions.
Figure 2:
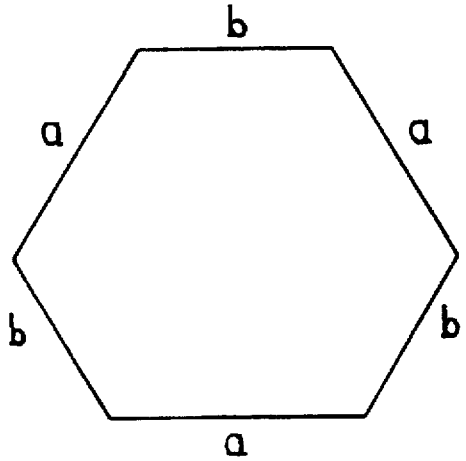
FIGS. 2 and 3 show a view of a hexagonal part and a pentagonal part, respectively, used in the ball according to the invention.
Figure 3:
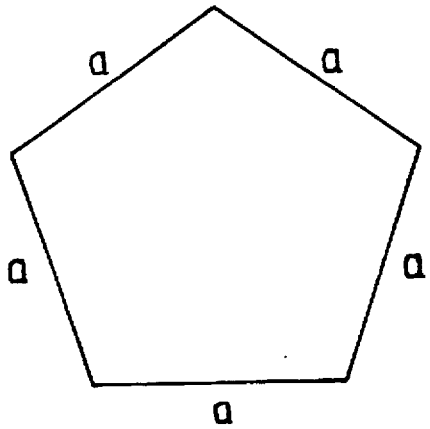

The ball according to the invention is composed of twelve equilateral pentagonal parts 1 and twenty hexagonal parts 2, each pentagon being connected to five hexagons and each hexagon being connected to three other hexagons and three pentagons.

According to the invention, the hexagons are equiangular, but not equilateral, the ratio between the length of the relatively short cathetuses b and the length of the relatively long cathetuses a being at least 0.69 and preferably 0.839. The length of the long cathetuses a corresponds to the length of a side of a pentagon. It has been established that by choosing $0.69\ a<b<a$, the difference in material stress and material stretch in the pentagons and hexagons of an inflated ball is smaller than when b is smaller than 0.69 a or greater than a. When the preferred value $b=0.839\ a$ is used, the material stress and the degree of stretch in the hexagons, in the inflated state of the ball, are virtually equal to the material stress and the degree of stretch in the pentagons. As long as the value of b is in the said range between a and 0.69 a, the difference in material stress and degree of stretch will be less than when a and b are equal, i.e. when the hexagons are equialateral.

The most important advantages of the invention are:

- the fact of whether a pentagon or a hexagon of the ball comes into contact with a shoe, a head or the ground does not have an effect on the movement of the ball, or has a smaller effect, and the player can be much more certain of the spot where a ball which has been kicked or headed, or a bouncing ball, will land,
- and the connections between the hexagons themselves and the connections between the hexagons and the pentagons are subjected to essentially the same stress and thus essentially the same wear phenomena,
- the hexagons do not wear more quickly than the pentagons,
- the productions process will have a smaller number of rejections or will allow higher tolerances.

We claim:

1. Inflatable ball for ball games, comprising an outer ball having a number of interconnected parts consisting of twelve equilateral pentagons and twenty equiangular hexagons, each pentagon being enclosed by five hexagons and at the location of the connection between a pentagon and a hexagon the sides connected to one another being of equal length, each of the hexagons having three sides (a) of relatively great length connected to a pentagon, and three sides (b) of relatively small length connected to a hexagon, and the relationship of the length of the short sides (b) and the length of the long sides (a) is a factor resulting in substantially equal values of material stress and degree of stretch in both the hexagons and pentagons.

2. Ball according to claim 1, wherein the length of the short sides (b) of each hexagon is about 0.839 times the length of the long sides (a).

* * * * *